US006139687A

United States Patent [19]

Beuther

[11] Patent Number: 6,139,687

[45] Date of Patent: Oct. 31, 2000

[54] CROSS-MACHINE DIRECTION STIFFENED DIVIDERS FOR A PAPERMAKING HEADBOX

[75] Inventor: Paul D. Beuther, Neenah, Wis.

[73] Assignee: Kimberly Clark Worldwide, Neenah, Wis.

[21] Appl. No.: 09/349,953

[22] Filed: Jul. 8, 1999

Related U.S. Application Data

[62] Division of application No. 08/990,832, Dec. 15, 1997.

[51] Int. Cl.[7] ..... D21F 11/02

[52] U.S. Cl. ..... 162/123; 162/216; 162/212

[58] Field of Search ..... 162/343, 344, 162/345, 346, 347, 216, 134, 140, 141, 336, 123, 212

[56] References Cited

U.S. PATENT DOCUMENTS

| | | | |
|---|---|---|---|
| 3,360,428 | 12/1967 | Loynd | 162/347 |
| 3,843,470 | 10/1974 | Betley et al. | 162/343 |
| 3,856,619 | 12/1974 | Davidson et al. | 162/343 |
| 4,070,238 | 1/1978 | Wahren | 162/343 |
| 4,141,788 | 2/1979 | Justus | 162/125 |
| 4,181,568 | 1/1980 | Pfaler | 162/343 |
| 4,358,342 | 11/1982 | Nuttall | 162/259 |
| 4,436,587 | 3/1984 | Andersson | 162/123 |
| 4,543,162 | 9/1985 | Hildebrand | 162/343 |
| 4,566,945 | 1/1986 | Ewald et al. | 162/343 |
| 4,604,164 | 8/1986 | Fujiwara et al. | 162/343 |
| 4,617,091 | 10/1986 | Rodal et al. | 162/343 |
| 4,812,208 | 3/1989 | Yuasa et al. | 162/343 |
| 4,812,209 | 3/1989 | Kinzler et al. | 162/343 |
| 4,824,524 | 4/1989 | Hilderbrand | 162/343 |
| 4,891,100 | 1/1990 | Hilderbrand | 162/343 |
| 5,013,406 | 5/1991 | Hergert | 162/343 |
| 5,129,988 | 7/1992 | Farrington, Jr. | 162/123 |
| 5,133,836 | 7/1992 | Allen | 162/343 |
| 5,545,294 | 8/1996 | Ruf et al. | 162/258 |
| 5,599,428 | 2/1997 | Meinecke et al. | 162/343 |
| 5,622,603 | 4/1997 | Begemann et al. | 162/343 |
| 5,645,689 | 7/1997 | Ruf et al. | 162/258 |

*Primary Examiner*—Stanley S. Silverman
*Assistant Examiner*—JoséA. Fortuna
*Attorney, Agent, or Firm*—Brinks Hofer Gilson & Lione

[57] ABSTRACT

Improvements in the internal dividers of a papermaking headbox are provided by stiffening the dividers only in the cross-machine direction. These cross-machine stiffened dividers provide for a smooth and thin divider that is flexible in the machine direction and yet is strong and resists distortion, buckling or bending in the cross-machine direction.

6 Claims, 4 Drawing Sheets

Fig. 6A
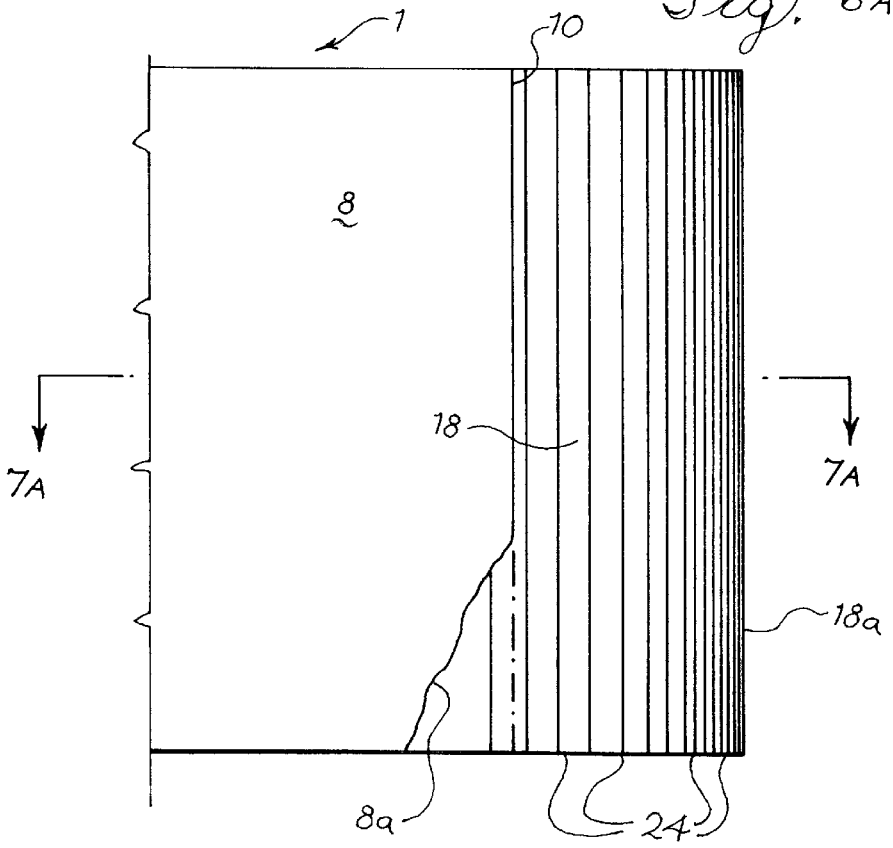
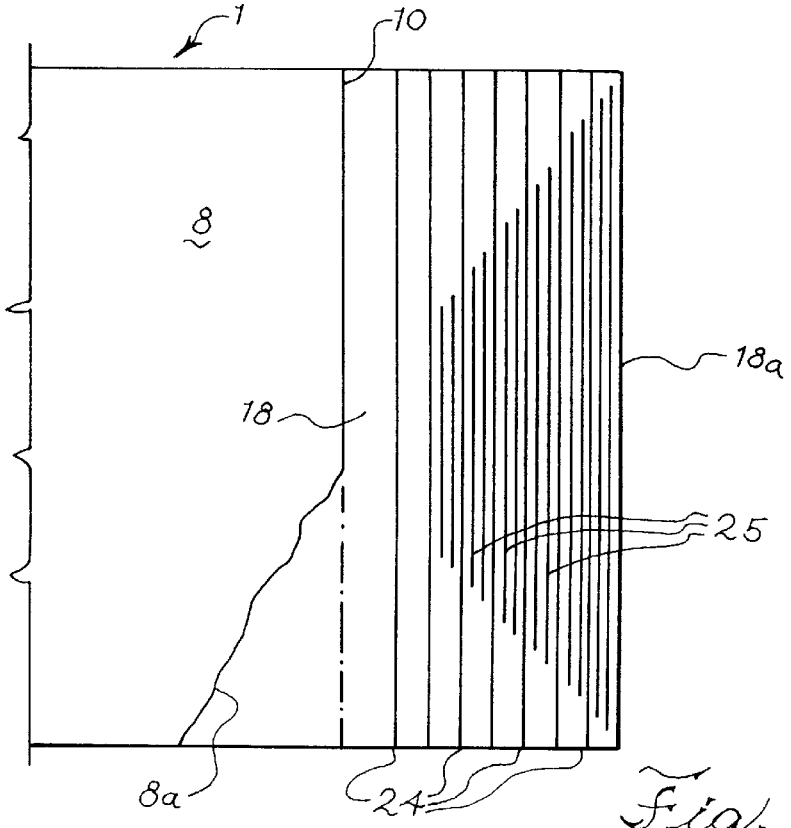
Fig. 6B

CROSS-MACHINE DIRECTION STIFFENED DIVIDERS FOR A PAPERMAKING HEADBOX

This is a divisional application of Ser. No. 08/990,832 filed Dec. 15, 1997, the disclosure of which is hereby incorporated by reference.

FIELD OF THE INVENTION

This invention is related to papermaking and is particularly directed to the dividers used in layered papermaking headboxes.

BACKGROUND OF THE INVENTION

The present invention is an advance in the art of papermaking. This invention enables layered paper and tissue to be made more efficiently and with greater cross-machine direction basis weight uniformity.

In the manufacture of paper sheets, including creped tissue paper, a headbox is used to deposit the papermaking stock onto a forming wire, where the stock is partially dewatered to form a paper web. In this process it is often advantageous to form the paper web in distinct layers of different fiber compositions. Layered headboxes having internal dividers are well known in the art to achieve this objective. In some of these layered headboxes, the internal dividers end before the slice opening. In others, they extend beyond the slice opening. Layered headboxes are disclosed in Betley et al. U.S. Pat. No. 3,843,470, Wahren U.S. Pat. No. 4,070,238, Justus U.S. Pat. No. 4,141,788, Farrington, Jr. U.S. Pat. No. 5,129,988, and Allen U.S. Pat. No. 5,133,836, all of which are incorporated herein by reference.

SUMMARY OF THE INVENTION

Improvements to the internal dividers of a papermaking headbox can be obtained by using reinforcing materials to stiffen them across their width, i.e., in the cross-machine direction. These stiffened dividers may have a smooth uniform surface over which the stock can pass. They will resist being deformed or displaced across their width by the stock. Thus, they will reduce cross-machine variations in basis weight, which in turn will have many benefits, including enhanced efficiency of the papermaking machine.

Thus, in one embodiment of this invention there is provided a multi-layered headbox comprising an upper wall having an upper lip and a lower wall having a lower lip. There is a space between the upper and lower lips forming a slice opening for aqueous suspensions of papermaking fibers to exit the headbox and a vane positioned between the upper and lower walls. There is also a cross-machine reinforced flexible extended divider having an upstream end and a downstream end, the upstream end being positioned within the headbox end, the downstream end extending beyond the slice opening from about 5 to 15 times the height of that opening.

In a further embodiment of this invention there is provided a papermaking machine headbox comprising an inlet manifold, a step diffuser tube bank and spaced apart upper and lower headbox walls. The upper wall having an upper lip, and the lower wall having a lower lip. The space between the upper and lower lips forming a slice opening for stock to exit the headbox. There is also a flexible divider in the headbox which has upstream, middle, and downstream sections. The downstream section making up no more than 30% of the total length of the divider with the upstream end of the flexible divider being adjacent to the step diffuser tube bank and having reinforcements located only on the downstream section.

In another embodiment of this invention there is provided a flexible extended divider for use in a papermaking headbox comprising an upstream end and a downstream end, an upstream end section corresponding to the upstream end, a middle section located adjacent and between the upstream end section and a downstream end section corresponding to the downstream end. The thickness of the divider decreasing from the upstream end to the downstream end in a gradual and uniform taper. The cross-machine stiffness of the downstream end section being greater than or equal to the cross-machine stiffness of the middle and upstream end sections and, the cross-machine stiffness of the downstream end section increasing from the point adjacent the middle section to the downstream end.

In yet a further embodiment of this invention there is provided a cross-machine direction stiffened papermaking machine headbox divider having an upstream and a downstream end, wherein the cross-machine direction stiffness and the machine direction stiffness are inversely related as viewed from the upstream end to the downstream end.

In still a further embodiment of this invention there is provided a method of making a multi-layered paper comprising the acts of forming an aqueous solution of papermaking fibers, pumping the aqueous solution to a papermaking headbox having a reinforced flexible extended divider therein. The divider having an upstream end and a downstream end. While in the headbox, flowing the aqueous solution over the divider from its upstream end to its downstream end and the aqueous solution exiting the headbox while still maintaining contact with the divider. The aqueous solution leaving contact with the divider at its downstream end and issuing from the divider as a free jet. The free jet impinging a forming zone of a papermaking machine, where water is removed from the aqueous solution to form a wet web and further dewatering the wet web to form a paper sheet. The divider while in contact with the aqueous solution after the aqueous solution exited the headbox resisting buckling and binding in the cross-machine direction thereby reducing cross-machine direction variations in the profile of the free jet and variations in cross-machine direction basis weight.

In yet another embodiment of this invention there is provided a method of making paper comprising forming an aqueous solution of papermaking fibers, moving the aqueous solution of papermaking fibers into a papermaking headbox, the aqueous solution of papermaking fibers then exiting the headbox through a slice opening in the headbox to form a free jet and controlling the cross-machine distribution of the aqueous solution of papermaking fibers in the free jet.

To aid in understanding the invention one is directed towards the drawings and the detailed description of the presently preferred embodiments of the invention.

BRIEF DESCRIPTION OF THE DRAWINGS

FIGS. 6A and 6B are plan views of an extended divider illustrating examples of the placement and distribution of fibers in the divider.

DETAILED DESCRIPTION OF PRESENTLY PREFERRED EMBODIMENTS OF THE INVENTION

Figure 1:
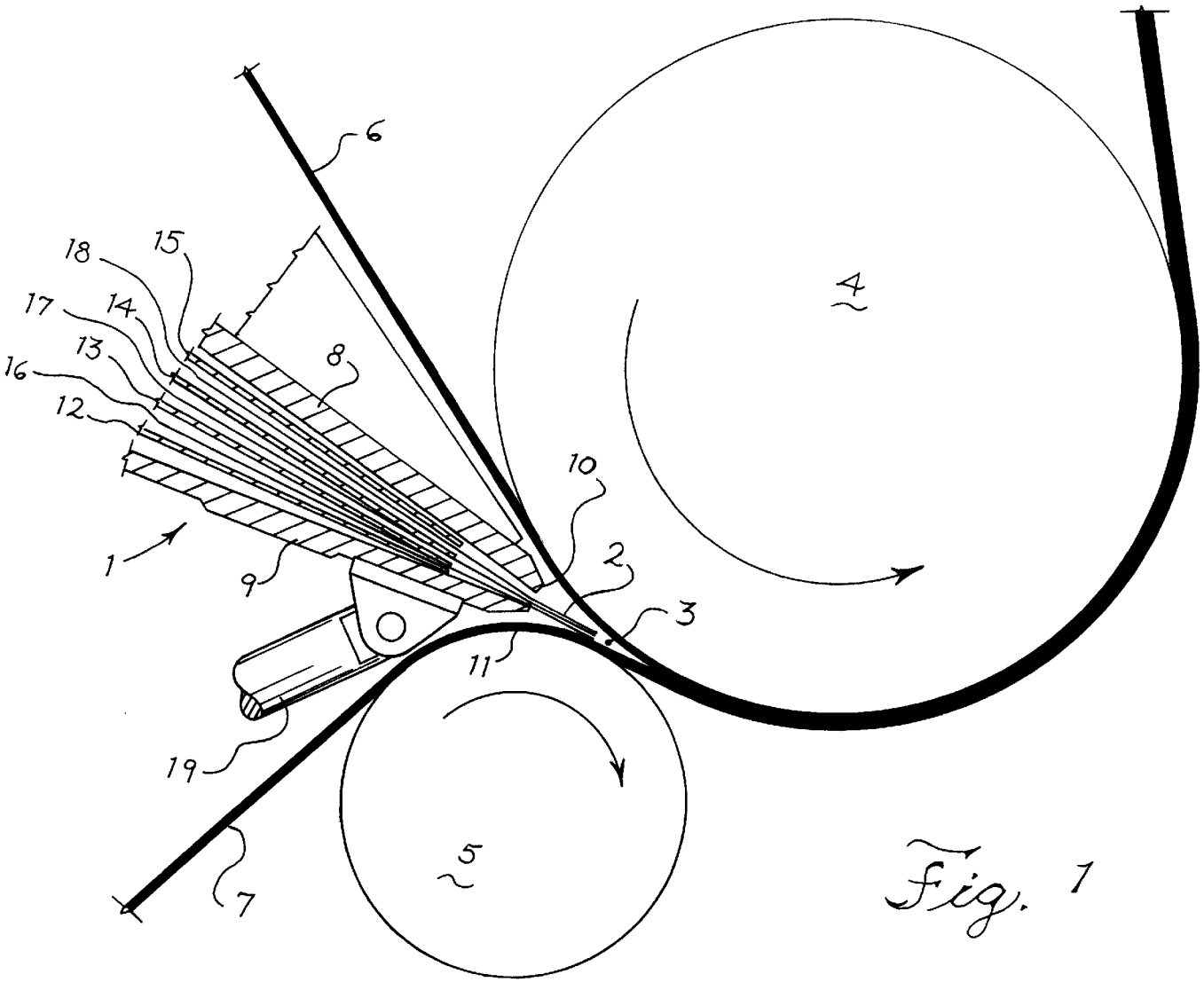
FIG. 1 is a cross-section schematical view of the forming zone of a conventional twin wire tissue making process showing the relationship of the headbox, slice opening and the free jet relative to the forming roll and the breast roll.

FIG. 1 is a cross-sectional schematic view of the forming zone of a twin wire tissue making machine. An aqueous suspension of papermaking fibers, which is referred to as papermaking stock or stock, is pumped to a headbox 1 by a fan pump (not shown).

The headbox 1 has an upper headbox wall 8 and a lower headbox wall 9. These upper and lower walls extend the length of the headbox ending at lips 10 and 11 respectively. The space between these lips is referred to as the slice opening. As used herein length is synonymous with the machine-direction and width is synonymous with the cross-machine direction of the papermaking machine.

The headbox 1 has three extended dividers 16, 17 and 18 that extend through the headbox and have portions 2 extending beyond the slice opening. A free jet 3 of the aqueous suspensions of papermaking fibers issues from the end of the portions 2 into the space between converging forming surfaces defined by a forming roll 4 and a breast roll 5.

The forming roll is partially wrapped by a first forming wire or fabric 6 and the breast roll is partially wrapped by a second forming wire or fabric 7. The forming roll may be solid or vacuum assisted. The free jet can be about one inch thick and can be from less than an inch to about 17 inches in length. The angle of the free jet's impingement and its point of impact will vary depending upon the forming process and geometry of the forming section of the papermaking machine.

A wet web of fibers is formed as water is removed from the aqueous suspension through the first and second forming wires. This wet web is then further processed in any suitable manner to produce a paper or tissue. Such processing typically includes further dewatering, drying, creping, winding and converting to the desired product form.

Upstream of the slice opening the headbox, illustrated in FIG. 1, is divided into several flow channels by vanes 12, 13, 14 and 15, and by extended dividers 16, 17 and 18. The vanes serve to generate fine scale turbulence in the headbox. The vanes end just upstream from the headbox slice opening at which point the flow is then divided into four flow channels by the dividers 16, 17 and 18. Although not shown, in FIG. 1 the vanes and the extended dividers could be rigidly, flexibly, or pivotally attached at their upstream ends in the headbox. The extended dividers 16, 17 and 18 have portions 2 that extend through the headbox slice opening and into the space between the forming surfaces. At portions 2, there still exists three separate dividers 16, 17 and 18.

Because of the required thinness of the extended dividers at their tips, the extended dividers are very flexible. The headbox walls, however, are rigid and their relative positions are fixed during operation, but can be controllably adjusted by an adjustment means such as the pivotable rod 19 shown attached to the lower headbox lip. Typical angles of convergence for top and bottom headbox walls of commercially available headboxes can be from 15° to 19°.

As the aqueous solutions of papermaking fibers pass through the multiple flow channels of the headbox, they converge until they reach the region of the slice opening. At that point in the process, the flows quickly transition to substantially parallel as they exit the slice opening. As the flows exit the slice opening, however, they are no longer confined by the rigid walls 8 and 9 of the headbox and are free to expand, bend and distort the extended dividers 16, 17 and 18. To control this bending and distortion across the width of the dividers, they are reinforced in a manner that does not substantially effect their thinness and ability to bend in the machine direction, but which stiffens them in the cross-machine direction.

The use of reinforcements to strengthen the extended dividers provides for a smooth and thin divider that is flexible in the machine direction and yet is strong and resists distortion, buckling or bending in the cross-machine direction, i.e., across its width. The reinforcements can be placed at any point along the length of the dividers provided that they are placed at the downstream end or tip of the dividers. For example, the reinforcements may be placed beginning at or near the point where the vanes end and extend to the downstream end of the dividers, i.e., the point where the flow jet issues from the dividers. The reinforcements may also be placed beginning at or slightly downstream from the slice opening and extend to the downstream end of the dividers. The reinforcements may also be positioned so that their length is substantially parallel to the cross-machine direction of the divider.

The reinforcements do not restrict the ability of the dividers to bend at the headbox slice opening along the flow streams. Thus, they do not prevent the divider from flexing or moving up and down (relative to the forming surfaces) as may be caused by the flow streams. This machine direction flexure is beneficial and is not significantly affected by the reinforcements. The reinforcements do, however, stiffen the divider in the cross-machine direction, thus, restricting the ability of the divider to bend or buckle in the cross-machine direction. This stiffening will improve layer purity and layer formation. It will also reduce cross-machine direction variations in the basis weight of the paper or tissue, and thus, provide a paper or tissue with a uniform or consistent cross-machine basis weight. Improved layer purity, formation and cross-machine basis weight profiles will also improve the overall runability, speed and efficiency of the papermaking machine.

The location, amount, type and pattern of the, reinforcements on the extended dividers will vary depending upon the papermaking equipment being used and the product being made, including the number of dividers being used, the shape of the headbox being used, the geometry of the forming zone being used and grade of paper or tissue being made. Additionally, the reinforcements may be located in one or all of the extended dividers or at different locations in different dividers within the same headbox. Further, different types of reinforcements may be used in the same divider. By way of example, and not to limit the type of reinforcements that may be used, the reinforcements may be fibers, sheets, webs, strands or wires. Materials such as aramid (Kevlar), glass, graphite, nylon, asbestos (and asbestos replacements), or metallic wires such as steel and aluminum may be used. Any other material that can be incorporated with the divider and that stiffens it in the cross-machine direction, and which can withstand the conditions in a papermaking machine may be used as reinforcements. The manner and techniques of incorporating such reinforcements into the materials or matrix used to make the divider are known to the art and are addressed in William P. Callister, Jr., *Material Science and Engineering: An Introduction* (1985, John Wiley & Sons), which is incorporated herein by reference.

Figure 2:
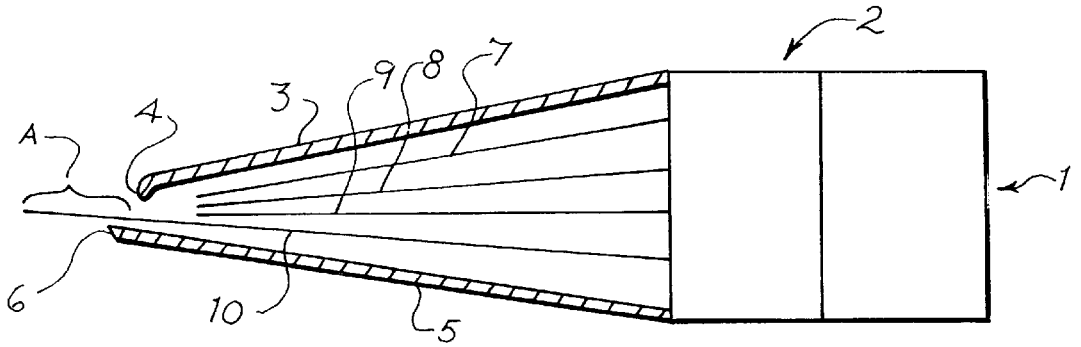
FIG. 2 is a schematic cross-sectional view of a headbox having an extended divider positioned adjacent to an apron lip.

In FIG. 2 there is shown a headbox having an inlet manifold 1, a step-diffuser tube bank 2, an upper wall 3 having an upper lip 4, a lower wall 5 having a lower lip 6, which extends beyond the upper lip to form an apron. The headbox of FIG. 2 has vanes 7, 8 and 9, and a flexible extended divider 10, which is rigidly fixed to the step-diffuser tube bank 2. The flexible extended divider may be made of any material which can withstand the headbox operating conditions, flex in response to fluid pressure, and have reinforcements bonded to or incorporated into it. Such materials may include polyesters, epoxies, phenolics, silicones and nylon. Various materials that are useful as matricies for reinforcements are discussed in Callister above, which incorporates by reference.

The thickness of the flexible extended divider can be, for example, about 0.40 inches at its upstream end and is preferably tapered toward its tip. The flexible extended divider extends beyond the slice opening a distance from about one time to about fifteen times the height of the slice opening. For example, the flexible extended divider can extend about 6 inches or more beyond a 0.5 inch slice opening in a tissue making headbox. The dividers are stiffened in the cross-machine direction by reinforcements that are placed in the area identified as A.

Figure 3:
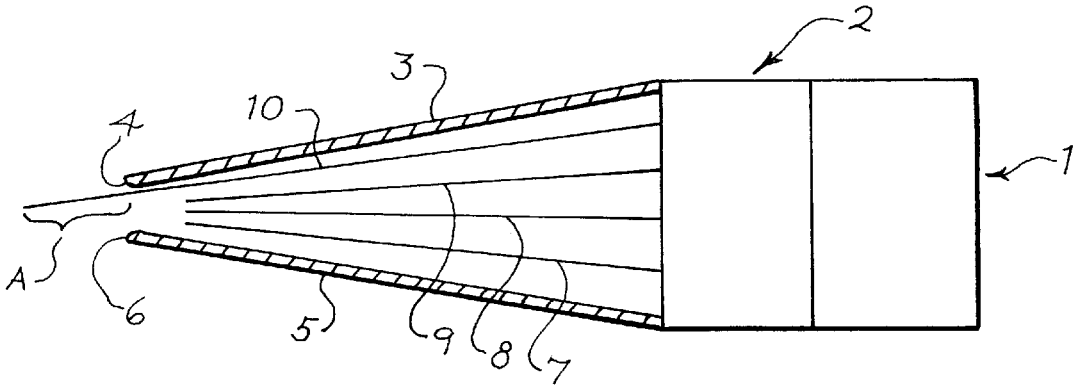
FIG. 3 is a schematic cross-sectional view of a headbox having an extended divider positioned adjacent a headbox lip.

In FIG. 3 there is shown a headbox having an inlet manifold 1, a step-diffuser tube bank 2, an upper wall 3 having an upper lip 4, a lower wall 5 having a lower lip 6, which ends at about the same downstream location as the upper lip. The headbox of FIG. 3 has vanes 7, 8 and 9, and a reinforced flexible extended divider 10. The reinforced flexible extended divider may be made of any suitable material as described above. The flexible extended divider extends beyond the slice opening a distance from about one time to about fifteen times the height of the slice opening. The divider is stiffened in the cross-machine direction by reinforcements that are placed in the area identified as A.

Figure 4:
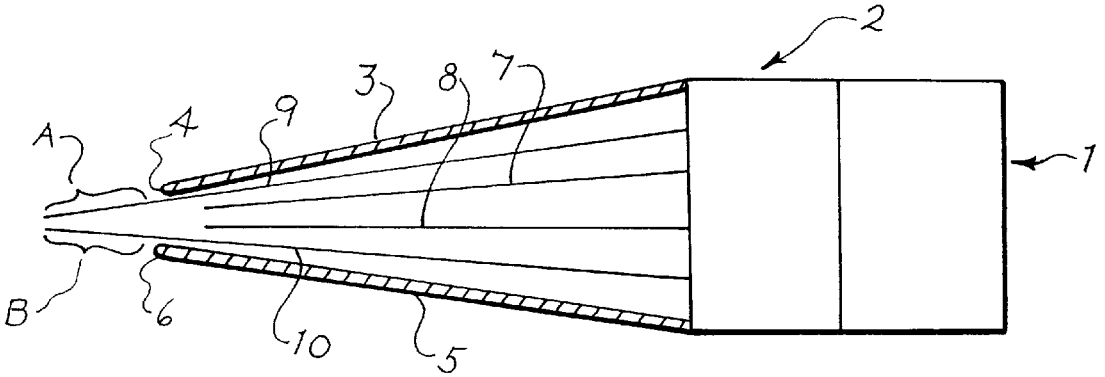
FIG. 4 is a schematic cross-sectional view of a headbox having extended dividers positioned adjacent to both headbox lips.

In FIG. 4 there is shown a headbox having an inlet manifold 1, a step-diffuser tube bank 2, an upper wall 3 having an upper lip 4, a lower wall 5 having a lower lip 6, which ends at about the same downstream location as the upper lip. The headbox of FIG. 4 has vanes 7 and 8, and two flexible extended dividers 9 and 10. The flexible extended dividers may be made of any suitable material as described above. The flexible extended dividers extend beyond the slice opening a distance from about one time to about fifteen times the height of the slice opening. One or both of the dividers can be stiffened in the cross-machine direction by the use of the reinforcements as described herein. The placement of the reinforcements can also be the same or different for the dividers. The degree of cross-machine stiffness can similarly be the same or different for the dividers. In the embodiment shown in FIG. 4, the reinforcements are placed in the areas identified as A on the upper divider and B on the lower divider.

Figure 5:
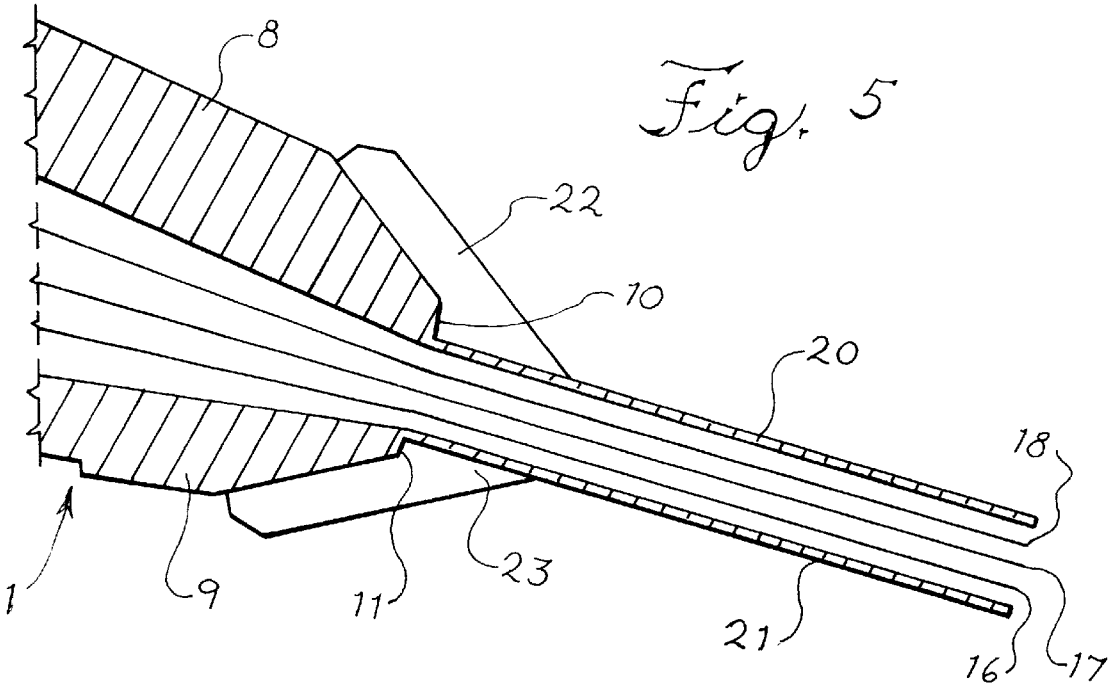
FIG. 5 is a schematic cross-sectional view of a headbox having lip extensions.

In FIG. 5 there is shown a headbox 1 of a similar design to that shown in FIG. 1. In the headbox of FIG. 7, reinforced flexible lip extensions 20 and 21 are coterminous with the headbox extended dividers 16, 17 and 18. The lip extensions are reinforced in a manner similar to the reinforcement of dividers as described above. The headbox lip extensions can be attached to the headbox by any suitable means, but in the embodiment shown in FIG. 6 they abut the headbox lips 10 and 11 and are supported by an upper support 22 and a lower support 23. One, two or three of the headbox extended dividers may also be reinforced.

FIGS. 6A and 6B show by way of example patterns for the positioning of the reinforcements in the extended dividers. These figures show a plan view of a headbox of a type similar to that shown in FIG. 1. The headbox 1, has an upper headbox wall 8 having an upper lip 10. The lower portion of the drawing of the headbox wall 8 is cut away at 8*a* to show the flexible extended divider 18 beneath it. The flexible extended divider 18 extends beyond the slice opening that is formed by upper lip 10 and a lower headbox lip (not shown) to end at its tip 18*a*. In operation the stock would flow from left to right as seen in these figures. Thus, the tip 18*a* would be the downstream end of the flexible extended divider 18. The upstream end of the divider, which is not shown in these figures, would be located within the headbox at or about the point where the stock first enters the headbox. The flexible extended dividers could be rigidly, flexibly, or pivotally attached to the headbox at their upstream ends, by means well known to the art.

Figure 7A:
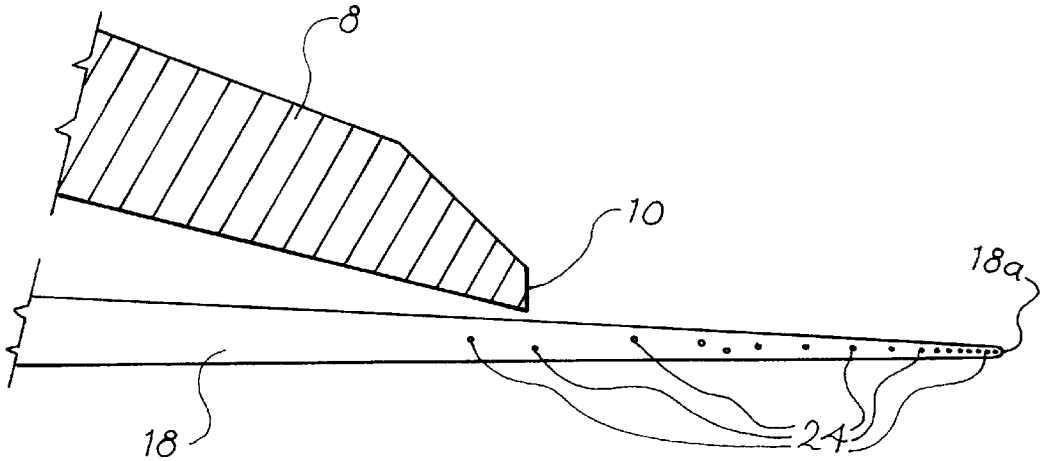
FIG. 7A is a cross-sectional view of the extended divider illustrated in FIG. 6A.

In the embodiment shown in FIGS. 6A and 7A, a multiplicity of reinforcing fibers 24 are placed substantially parallel to the tip 18*a* of the flexible divider 18. The spacing between the reinforced fibers gradually decreases from the upstream fibers located at or near this slice opening to the tip 18*a*, where they are spaced closest together. This placement or spacing of the reinforced fibers provides a reinforced flexible divider, that is very flexible in the machine direction, while having a gradually decreasing flexibility in the cross-machine direction from the slice opening to the tip. Moreover, because the thickness of the extended divider is decreasing as one moves downstream away from the slice opening toward the tip, the machine-direction stiffness would also be decreasing as one moves downstream away from the slice opening. Thus, the degree-of machine direction flexibility would be inversely related to the degree of cross-machine flexibility as one moves downstream along the divider from the slice opening to its tip. FIG. 7A is a cross-section of the reinforce flexible divider shown in FIG. 6A. In this figure, fibers 24 are drawn larger than their actual relative size to the divider. The fibers could be much thinner and thus could be layered one on top of the other within the divider.

Another pattern for the spacing and placement of reinforcing materials is shown in FIG. 6B. In that figure, there are shown evenly spaced reinforcement materials 24 that extend across the entire width of the flexible excluded divider and addition reinforcement materials 25 interspersed between the materials fibers 24.

While the invention has been described in connection with certain presently preferred embodiments, those skilled in the art will recognize modifications to structures, arrangements, portions, elements, materials and components which can used in practice of this invention without departing from the principles of this invention.

I claim:

1. A method of making a multi-layered paper comprising the acts of:

(a) forming an aqueous solution of papennaking fibers;

(b) pumping the aqueous solution to a papermaking headbox having a reinforced flexible extended divider therein;

(c) the divider having an upstream end a middle section and a downstream end, the cross-machine stiffness of the downstream end being greater than or equal to the cross-machine stiffness of the middle section and upstream end sections, and, the cross-machine stiffness of the downstream end increasing from the point adjacent the middle section to the downstream end;

(d) while in the headbox, flowing the aqueous solution over the divider from its upstream end to its downstream end;

(e) the aqueous solution exiting the headbox while still maintaining contact with the divider;

(f) the aqueous solution leaving contact with the divider at its downstream end and issuing from the divider as a free jet;

(g) the free jet impinging a forming zone of a papermaking machine, where water is removed from the aqueous solution to form a wet web and further dewatering the wet web to form a paper sheet; and, (h) the divider while in contact with the aqueous solution after the aqueous solution exited the headbox resisting buckling and binding in the cross-machine direction thereby reducing cross-machine direction variations in the profile of the free jet and variations in cross-machine direction basis weight.

2. The method of claim 1 in which the divider is reinforced with graphite fibers.

3. The method of claim 1 in which the divider is reinforced with glass fibers.

4. The method of claim 1 in which the divider is reinforced with metal wire.

5. The method of claim 1 in which the divider is reinforced with aramid.

6. The method of claim 1 in which the divider is reinforced with nylon.

* * * * *

UNITED STATES PATENT AND TRADEMARK OFFICE

CERTIFICATE OF CORRECTION

PATENT NO. : 6,139,687
DATED : October 31, 2000
INVENTOR(S) : Paul D. Beuther

It is certified that error appears in the above-identified patent and that said Letters Patent is hereby corrected as shown below:

Title page,
Column 2,
Line 9, change "Hilderbrand" to -- Hildebrand --.
Line 10, change "Hilderbrand" to -- Hildebrand --.

Claim 1,
Line 3, change "papennaking" to -- papermaking --.

Signed and Sealed this

Twelfth Day of February, 2002

*Attest:*

*Attesting Officer*

JAMES E. ROGAN
*Director of the United States Patent and Trademark Office*